United States Patent [19]

Thornton

[11] 4,355,479

[45] Oct. 26, 1982

[54] SIGN CONSTRUCTION HAVING SELECTIVELY DISPLAYABLE DIRECTIONAL SIGNALS AND IMPROVED MOUNTING BRACKET

[76] Inventor: Arthur G. Thornton, 1312 Merona Pl., Anaheim, Calif. 92805

[21] Appl. No.: 179,046

[22] Filed: Aug. 18, 1980

[51] Int. Cl.[3] ..... G09F 13/04; G09F 7/00

[52] U.S. Cl. ..... 40/570; 40/488; 40/491

[58] Field of Search ..... 40/570, 488, 152.1, 40/486, 156, 611, 152, 490, 575, 491, 576

[56] References Cited

U.S. PATENT DOCUMENTS

| | | | |
|---|---|---|---|
| 601,144 | 3/1898 | Howe | 40/155 |
| 2,154,959 | 4/1939 | Roose | 40/156 |
| 3,309,806 | 3/1967 | Gallagher | 40/570 |
| 3,478,455 | 11/1969 | Fremont | 40/570 |
| 3,562,942 | 2/1971 | Mabrey | 40/570 |
| 3,591,941 | 7/1971 | Jaffe, Jr. | 40/570 |
| 3,665,626 | 5/1972 | Lund et al. | 40/570 |
| 3,916,404 | 10/1975 | Gouge | 40/570 |
| 3,931,689 | 1/1976 | Shine | 40/570 |

*Primary Examiner*—Gene Mancene
*Assistant Examiner*—Michael Foycik
*Attorney, Agent, or Firm*—Mahoney & Schick

[57] ABSTRACT

An electrically illuminated sign has a box-like frame with a front face opening and encloses a message plate displaying a message unit through the opening. A separate opaque border strip circumscribes the message unit of the message plate forwardly overlying the same and being forwardly engaged by a frame flange. Opposite side parts of the border strip have directional signal openings formed therethrough normally exposing a contrasting coloration of the message plate therethrough and selectively slidably removable cover strips are positioned between the message plate and border strip covering the border strip directional signal openings with a coloration matching the border strip. The sign may be attached to a mounting surface by a two-piece mounting bracket having a first part secured to the frame and a second part securable to the mounting surface with the bracket parts having slidably interfitting dove-tail portions securing the parts. The bracket may also include selectively separable electrical connector parts on each of the bracket parts which are automatically brought into electrical connection upon the bracket parts being brought into slidable securement, thereby directing electrical power from the mounting surface through the mounting bracket into the sign.

4 Claims, 6 Drawing Figures

SIGN CONSTRUCTION HAVING SELECTIVELY DISPLAYABLE DIRECTIONAL SIGNALS AND IMPROVED MOUNTING BRACKET

BACKGROUND OF THE INVENTION

This invention relates to a sign construction and is particularly adaptable for use in sign constructions of the instructional type, such as "exit" signs, mounted in and around building structures for directing people in the use of such building structures. More particularly, this invention relates to an improved sign construction having integrated directly therein selectively displayable directional signals which may be conventionally maintained non-displayable or may be uncovered for display at the choice of the workmen mounting and maintaining the particular sign. Also, the improved sign construction may include an improved mounting bracket therefor in mounting the same on a supporting surface in a secure manner and having means integrated therewith for directing electrical power into the sign construction for the illumination thereof and without the use of exterior electrical power lines.

Various prior forms of instructional signs for building interiors, such as "exit" signs and similar, have heretofore been provided. Furthermore, although there are many occasions where it is only necessary to provide the sign for displaying a main message unit, taking "exit" signs as a prime example, the main message unit being the word "exit," there are an equal number of instances where it is necessary to provide one or more directional signals on or adjacent the sign to indicate the direction of the particular exit. Where the exit sign may be mounted directly above or directly beside the exit to be indicated and that sign and exit may be observed by a person requiring the same from a reasonable distance, there is usually no necessity of additional display of additional directional signals such as directional arrows and the like. However, where the particular exit is required to be around a building passage corner so as to be somewhat secluded, or it is necessary to provide an exit sign intermediate the pathway to an exit, then the additional directional signal or signals are of a vital requirement and necessity.

Prior to the present invention, where the additional directional signals have been required in addition to the main message exit signal, they have been provided in one of alternate known manners. One manner has been to provide the directional signal display on a completely separate and separately mounted sign, thereby requiring sign component duplication to a greater or lesser degree depending upon the number of directional signal displays required and particularly including a duplication of original fabrication expense and continuing maintenance expense. Another manner of providing the additional directional signal displays has been to specifically integrate the same into the main sign construction in addition to the main sign message display resulting in a multiplicity of different forms of signs being required to be provided in order to satisfy all of the many variations of possible directional signals, for instance, one sign model with no directional signal display, one sign model with a directional signal display to the right, one sign model with a directional signal display to the left and one sign model with directional signal displays to both the right and left, all of which contributes to increased expense in providing the various multiple models.

Another problem with sign constructions of the general type discussed is the particular means for mounting the same on a supporting surface, as well as providing the direction of electrical power thereto in order to illuminate the same. Signs of the general character discussed, such as building exit signs, once installed, must remain securely mounted over a long period of use amounting to many years. Furthermore, in the case of important people directing instructional signs, such as exit signs, in buildings, such signs are of extreme importance since, in many cases, it is just these exit signs that direct people to a required emergency exit of the building when various types of emergencies occur such as fire and similar to that it is extremely important that such signs remain mounted where intended in a secure manner and are fully properly visible.

Obviously, proper visibility of the signs not only depends on secure mounting thereof in the predetermined intended location, but also that the exit message signals and the directional signals thereof be electrically illuminated, thereby requiring the direction of electrical power into the signs. In the prior sign constructions, electrical power has been directed thereto by use of separate cables leading from the particular mounting surface upon which the sign is supported such as walls or ceilings to the signs spaced therefrom. In many cases, these separate, visible electric cables have been unsightly. Equally important, when it has been necessary to remove the prior signs from their mounting positions for maintenance or replacement, disconnecting and reconnecting of the separate electrical power lines has been somewhat difficult and time consuming, depending on the particular sign mounting position.

OBJECTS AND SUMMARY OF THE INVENTION

It is, therefore, an object of this invention to provide a sign construction generally of the instructional message type as used in buildings and the like for directing the movement of people into, within and from such buildings which sign construction is of an improved form over the prior similar sign constructions. One of the improvements in the sign construction may relate to the display of various forms of message units thereby in a more convenient and alternate choice manner. Another improvement may include the particular construction provided for mounting the various sign constructions which is conveniently adaptable to virtually any form of sign construction mounting in a highly secure manner over a long period of time. This improved sign mounting construction may also include further improvements in the manner of directing electrical power to the various signs from the mounting surfaces upon which they are mounted.

It is a further object of this invention to provide a sign construction of the foregoing general type wherein the message unit display improvements thereof when incorporated may include a unique combination of sign elements arranged to display a main message unit, for instance, such as the word "exit," in somewhat usual manner, but incorporates therewith a selection of supplementary directional message units, all in a single model of the sign construction. According to a preferred embodiment of the sign construction, a single sign model may be quickly and conveniently altered so as to provide no directional signal display in addition to the main message unit display, a single additional directional message unit display or multiple directional message unit displays, the choice for the various displays being made at the time of original sign construction installation or at a later time if conditions dictate with little difficulty. Thus, a single model of sign construction will serve the exact same purpose as the multiplicity of prior sign construction models so as to greatly reduce sign construction cost in providing efficient instructional messages for directing the movement of people in a particular building structure.

It is a further object of this invention to provide a sign construction of the foregoing general type which may incorporate an improved mounting bracket for the various signs in mounting and maintaining the same supported in proper and efficient message display position on a building supporting surface, all in a permanent manner over a long period of years. Again, in a preferred embodiment form, the mounting bracket preferably includes interfitting sign and mounting surface parts which slidably interengage in dove-tail fashion with such interengagement resulting in the slidable interfitting being perfectly compatible with use of the bracket to support a particular sign by use of any sign mounting surface. For instance, assuming a sign front message unit display, the bracket is adaptable for mounting the sign using any other of the sign frame surfaces, such as back, either side or top or bottom. In this manner, and with the improved bracket construction, a single sign model may be adapted for virtually any position of mounting so as to eliminate the requirement for multiple sign models as has been prevelant in the prior constructions.

In addition to the foregoing, the preferred embodiment of the mounting bracket improvements may include a much more efficient, convenient and overall aesthetically pleasing manner of directing electrical power into the sign from its mounting surface for the illumination of the sign. Separate power cables are totally eliminated since the mounting bracket directly integrates therein a power line slidable connection which automatically is brought into power transmitting connection when the bracket parts are brought into sign supporting connection. This thereby not only eliminates the unsightliness of separate electrical power lines or cables, but also provides for an extremely simple and efficient electrical power connection without further effort at the time of original sign mounting or at any other time that it is necessary to remove and replace the sign from its particular mounted position.

Other objects and advantages of the invention will be apparent from the following specification and the accompanying drawings which are for the purpose of illustration only.

DESCRIPTION OF THE BEST EMBODIMENTS CONTEMPLATED

Figure 1:
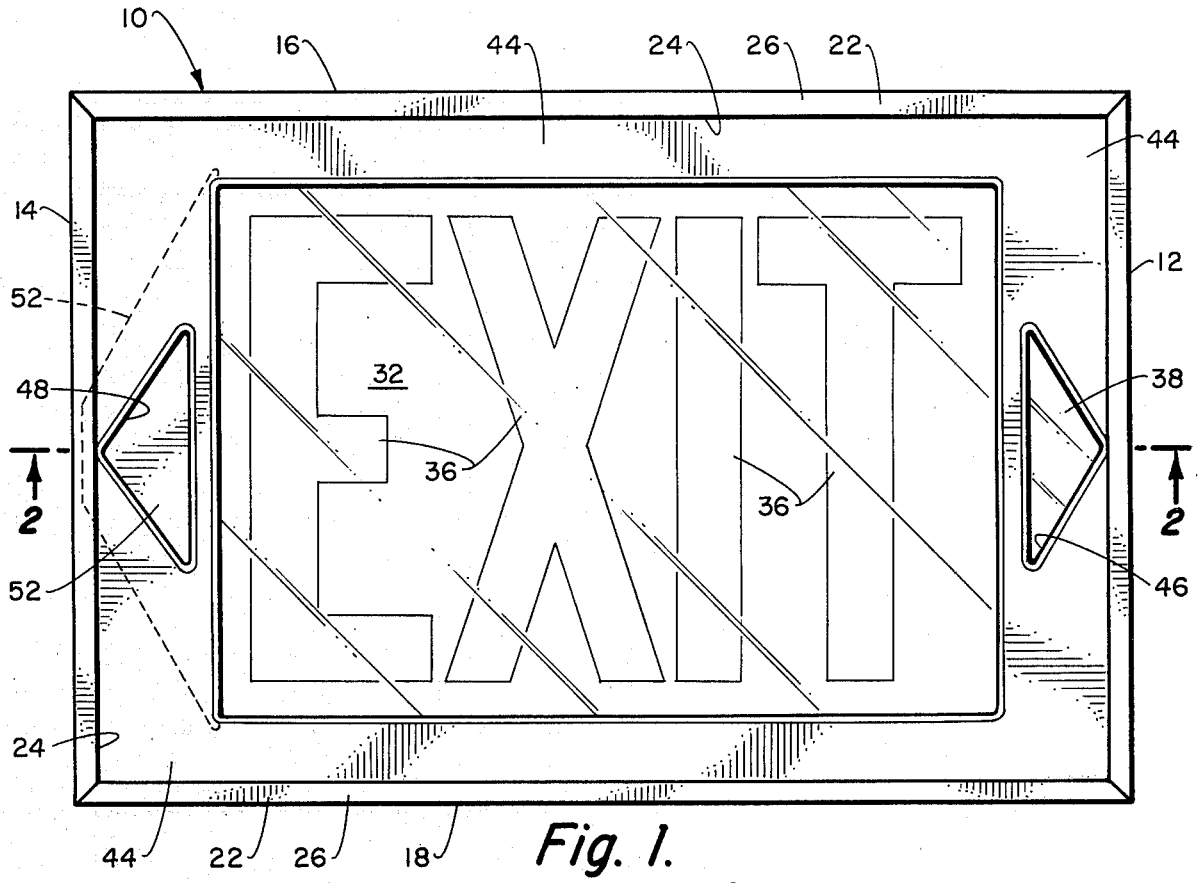
FIG. 1 is a front elevational view of a preferred embodiment of the improved sign construction of the present invention.

Referring to the drawings, a preferred embodiment of the improved sign construction of the present invention incorporating both the selectively displayable directional signal improvements and the mounting bracket improvements is illustrated. Initially, it is pointed out that the sign construction improvements of the present invention may be advantageously incorporated, both individually and in combination, in various sign constructions other than that illustrated and that it is not intended to limit the principles of the invention to this particular embodiment, but rather to apply the same equally to other sign construction forms which are compatible therewith. Furthermore, except as otherwise specifically pointed out, sign constructions incorporating the principles of the present invention may be constructed from usual materials in usual manner well known to those skilled in the art.

As shown, the sign construction includes a preferably rectilinearly shaped, box-like frame generally indicated at 10 having generally flat right side panel 12, left side panel 14, top panel 16, bottom panel 18 and back panel 20. A front face 22 of the frame 10 is formed with a front face opening 24 defined by a circumscribing flange 26 extending transversely and vertically inwardly from the various side, top and bottom panels 12, 14, 16 and 18. Furthermore, a circumscribing engagement flange 28 projects inwardly into interior 30 of the frame 10 intermediate thereof and spaced rearwardly from the front face frames 26, the engagement flange also preferably being secured to all of the side, top and bottom panels 12, 14, 16 and 18.

Figure 6:
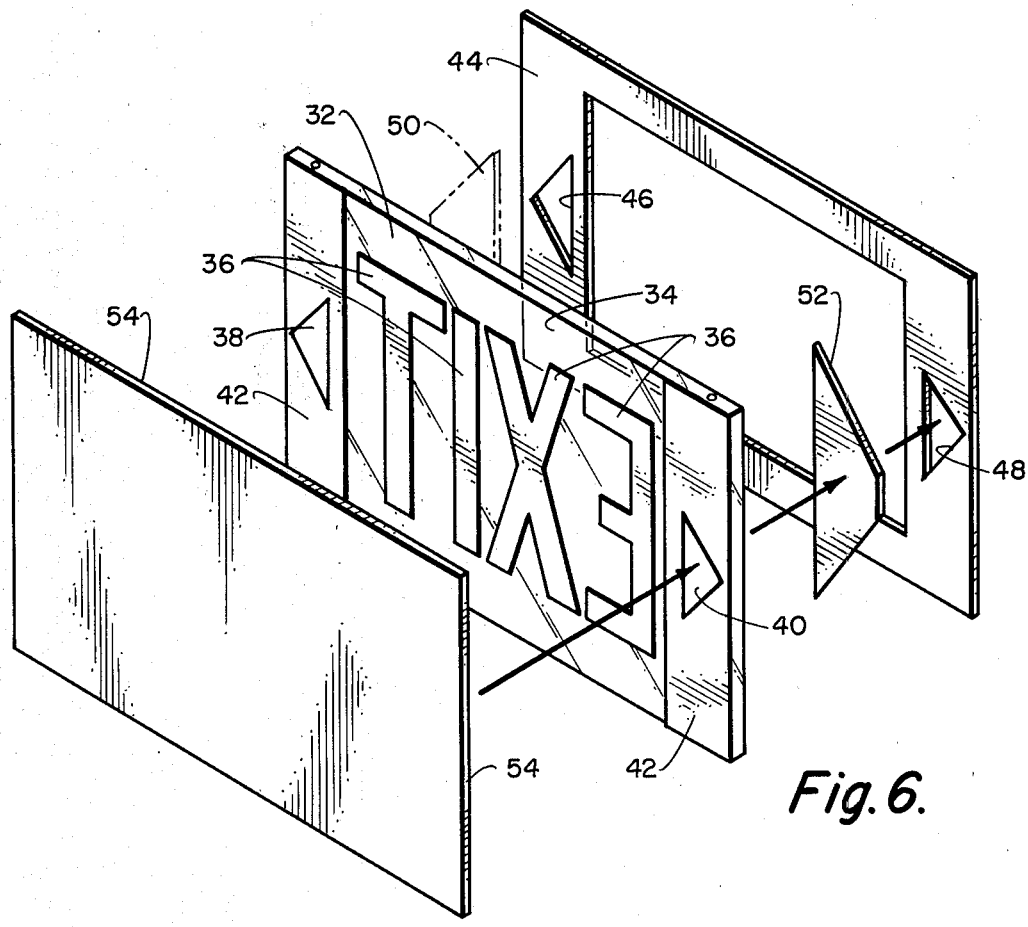
FIG. 6 is a partial exploded perspective view of the sign construction of FIGS. 1 through 5 illustrating the alternate message unit display improvements.

A transparent message plate 32 is positioned within the frame interior 30 rearwardly of the front face flange 26 and forwardly of the interior engagement flange 28, the message plate preferably being in edge interference with both of these flanges. This message plate 32 on the rear surface 34 thereof has a somewhat centralized, colored, say green, main message unit 36 painted thereon, in this case the word "exit" as best seen in FIGS. 1 and 6. Also, at the opposite side edges of rear surface 34 are similarly formed of similar coloration a right signal indicator 38 and a left signal indicator 40 which are spaced to the side of the main message unit 36 as best seen from the rear in FIG. 6.

The right and left signal indicators 38 and 40 are shown in the shapes of arrowheads, the right signal indicator 38 pointing to the right of the sign as viewed from the front and the left signal indicator 40 pointing to the left. Furthermore, the signal indicators 38 and 40 are preferably outlined by engraving directly in the back surface of the message plate 32 and are formed within rectangular painted side edge strips 42 of similar but slightly less intense coloration so that the signal indicators 38 and 40 stand out therefrom. For similar increased display intensity, the letters of the main message unit 36 may be similarly line edge engraved or outline engraved.

An opaque border strip 44 is positioned in the frame 10 forwardly between the message plate 32 and the front face flange 26 in edge interference with the front face flange and therefore forwardly edge engageable therewith. The border strip 44 preferably circumscribes the main message unit 36 spaced outwardly therefrom and registers with or slightly overlaps the rectangular side edge strips 42 on the message plate 32. The border strip 44 has opposite side directional signal openings 46 and 48 formed therethrough similarly shaped and exactly rearwardly registering with the respective right and left signal indicators 38 and 40 on the message plate 32, these openings preferably closely outwardly bordering the line engraving of the message plate signal indicators 38 and 40. Selectively slideably removable, enlarged somewhat arrowhed shaped right and left cover strips 50 and 52 are originally positioned, as will be hereinafter explained, between the message plate 32 and the side edge portions of the border strip 44 overlap registering with and thereby completely closing the right and left directional signal openings 46 and 48 of the border strip 44. Both the forward surfaces of the border strip 44 and the right and left cover strips 50 and 52 are of contrasting coloration to the coloration of the main message unit 36 and right and left signal indicators 38 and 40 of the message plate 32.

An opaque backing plate 54 also of forward surface contrasting coloration, such as black, to the main message unit 36 and right and left signal indicators 38 and 40 is positioned rearwardly of the message plate 32, the backing plate extending completely across the frame interior 30 and forwardly in edge interference with the frame interior engagement flange 28 completely around the backing plate periphery. A series of leaf springs 56 are positioned between the frame engagement flange 28 and the edge portions of the backing plate 54 resiliently urging the backing plate 54, the message plate 32, the right and left cover strips 50 and 52, and the border strip 44 into respective forward abutment, and into forward engagement with the rear surface of the frame front face flange 26. Thus, not only are these various sign elements resiliently retained in assembly within the frame 10, but this assembly resilient retention permits the message plate 32 to be urged rearwardly relative to the border strip 44 at any time for the removal or assembly of the right and left cover strips 50 and 52 slideably from and to their assembled positioning covering the right and left signal indicators 38 and 40 for purposes to be hereinafter described.

Figure 2:
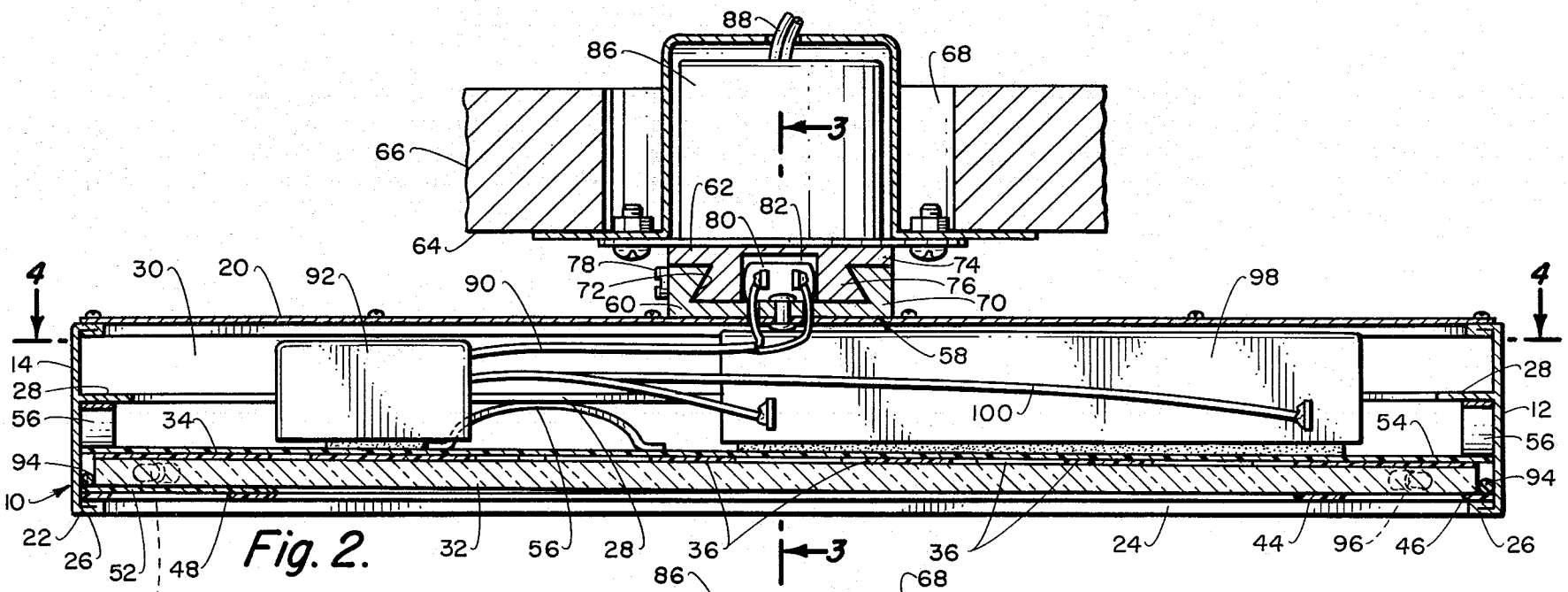
FIG. 2 is an enlarged, horizontal sectional view looking in the direction of the arrows 2—2 in FIG. 1, a building wall structure upon which the sign construction is mounted being shown in fragmentary view.
Figure 3:
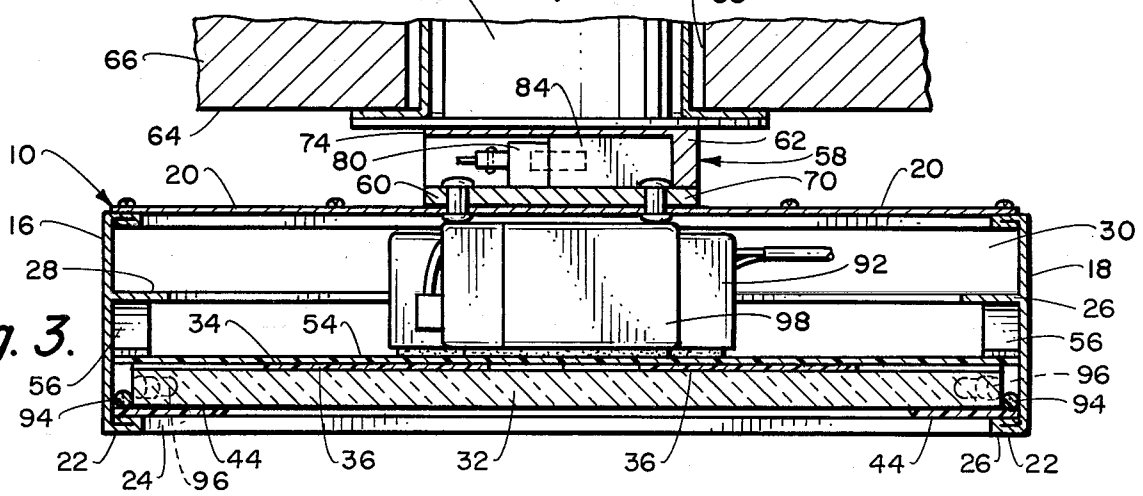
FIG. 3 is a vertical sectional view looking in the direction of the arrows 3—3 in FIG. 2.
Figure 5:
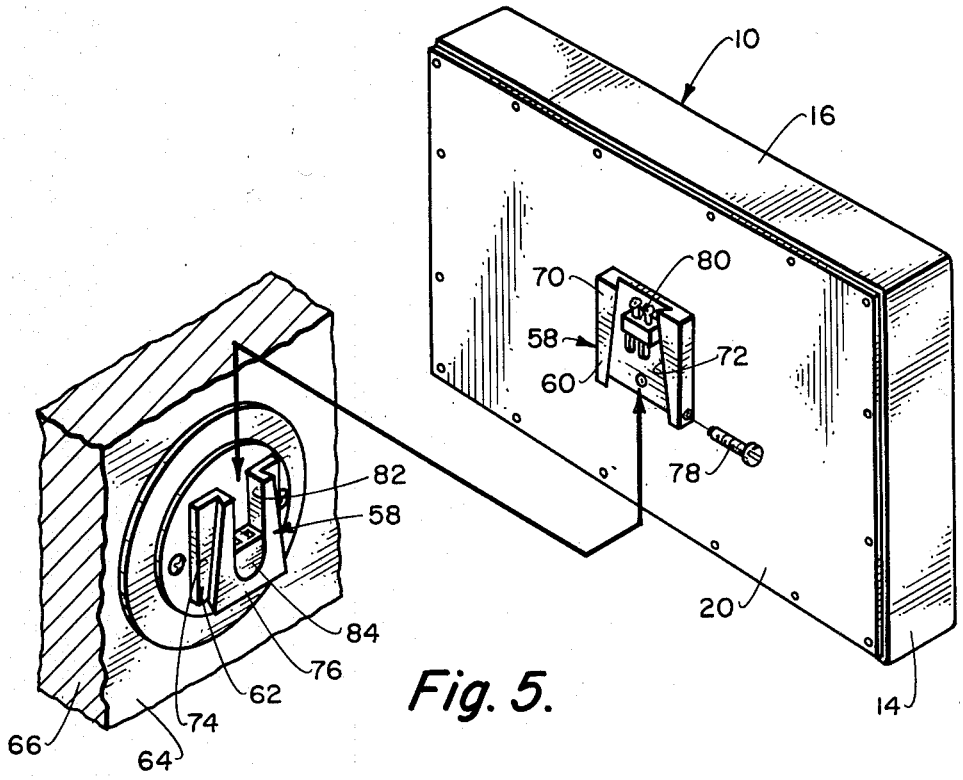
FIG. 5 is a partially exploded perspective view showing the sign construction of FIGS. 1 through 4 immediately prior to building wall mounting of the same using the bracket construction improvements of the present invention.

The improved mounting bracket of the present invention is shown in FIGS. 2, 3 and 5, being generally indicated at 58 and including a first sign part 60 and a second mounting surface part 62. The bracket sign part 60 is secured to any preferably flat surface of the sign frame 10 which will mount and position the sign relative to a mounting surface as is desired for that particular sign, that is, the bracket sign part 60 may be secured to any of the sign frame side, top, bottom and back panels 12, 14, 16, 18 and 20 as is required for the particular sign mounting position relative to a particular mounting surface, in this case, the sign frame back panel 20 as shown. The bracket mounting surface part 62, obviously, is securable to the appropriate vertical or horizontal mounting surface for selective inter-engagement by the bracket sign part 60 as will be hereinafter explained, in this case the bracket mounting surface part 62 being secured to a vertical wall mounting surface 64 of a building wall 66 registering with a wall opening 68 for a purpose to be hereinafter described.

The bracket sign part 60 is formed from a generally square block 70 having a longitudinally extending and transversely decreasing dove-tail recess 72 formed therein from bottom to top and opening outwardly. The dove-tail recess 72 is angled undercut transversely preferably throughout the longitudinal extension thereof. The bracket mounting surface part 62, likewise formed from a generally square block 72, has a matching dove-tail projection 76, that is, transversely decreasing in a longitudinal extension from bottom to top but transversely angling outwardly to match the dove-tail recess 72 of the bracket sign part 60.

Thus, with the sign frame 10 positioned vertically above the bracket mounting surface part 62 and the bracket sign part 60 vertically aligned with the bracket mounting surface part, downward movement will slideably interengage or interfit the dove-tail projection 76 within the dove-tail recess 72 thereby slideably securing the bracket parts 60 and 62 against both longitudinal or vertical and transverse or horizontal movement relative to each other. Furthermore, the transversely angled undercut of the dove-tail recess 72 and the transversely outwardly angling of the dove-tail projection 76 will secure the bracket parts 60 and 62 against separation normal to the sign frame back panel 20 so as to securely mount the sign frame 10 on the wall mounting surface 64 of the building wall 66 in the manner shown in FIGS. 2 and 3. A set screw 78 may be threadably received in the bracket sign part 60 as shown in FIG. 5 for securing the bracket parts 60 and 62 together in their interengaged positioning.

Forming a part of the electrical power system of the sign of the present invention for electrically illuminating the same, a male electrical connector 80 is mounted generally centrally within the dove-tail recess 72 of the bracket sign part 60. A longitudinally upwardly opening cutout 82 is formed in the dove-tail projection 76 of the bracket mounting surface part 62 having a female electrical connector 84 mounted therein at the lower portion thereof. These electrical connectors 80 and 84 are longitudinally aligned such that when the bracket parts 60 and 62 are slideably brought into final interfitting engagement, these connectors are automatically longitudinally slideably brought into proper electrical power transmitting connection.

Figure 4:
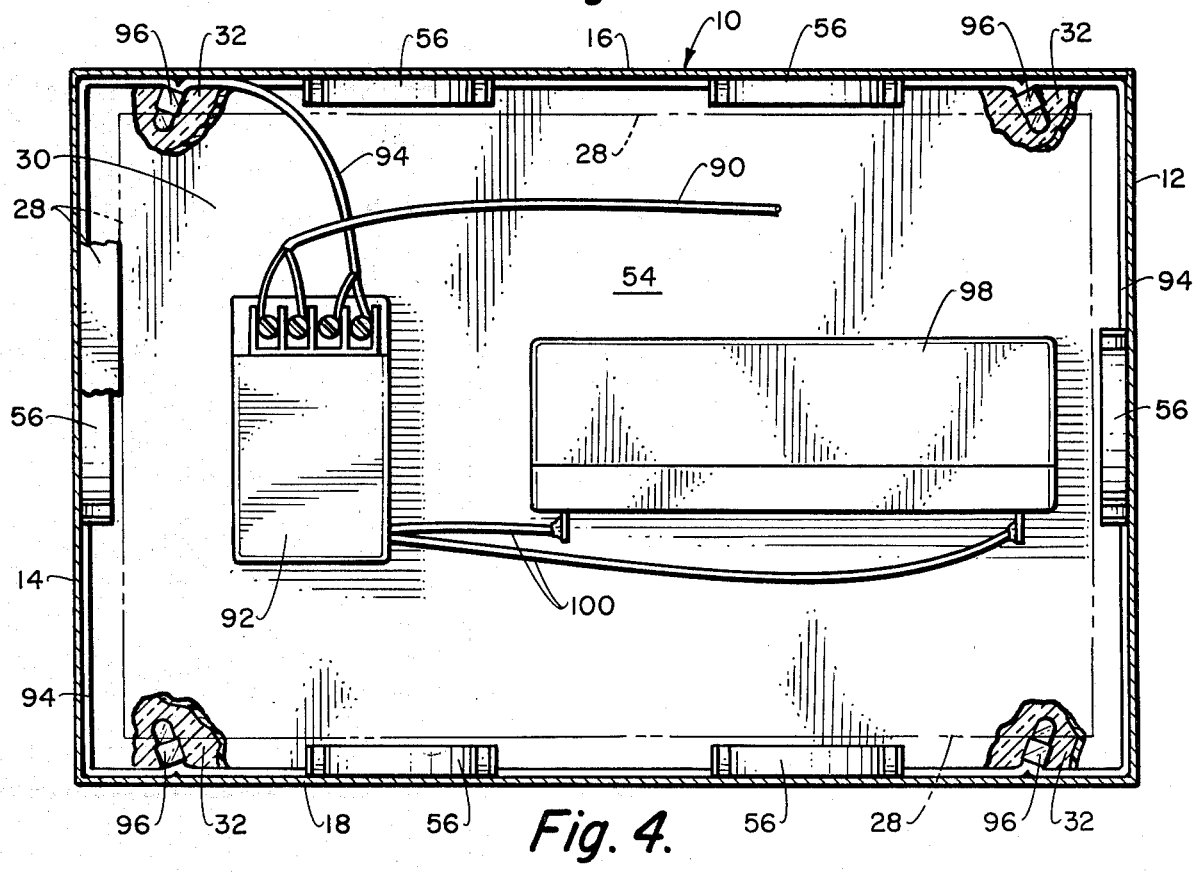
FIG. 4 is a reduced, vertical sectional view looking in the direction of the arrows 4—4 in FIG. 2.

As hereinbefore described, the bracket mounting surface part 62 is secured to the vertical wall mounting surface 64 of the building wall 66 registering with the wall opening 68 and a transformer 86 is also secured to building wall within the wall opening 68 as shown in FIGS. 2 and 3. The transformer 86 receives electrical power through a building main electrical power line 88 at standard building voltage, say 120 volts, and reduces that voltage to preferably 12 volts which, in turn, is transmitted directly into the female electrical connector 84 of the bracket mounting surface part 62. This 12 volt electrical power is transmitted from the female electrical connector 84 of the bracket mounting surface part 62 into the male electrical connector 80 of the bracket sign part 60 and from there directly into the internal sign electrical power supply line 90 as best seen in FIGS. 2 and 4.

Thus, the sign receives the low 12 volt electrical power and this is standard alternating current electrical power. The sign electrical power supply line 90 directs this power into an automatic switchover device 92 which, as will be explained more in detail below, normally transmits the same into a bulb electrical power supply line 94 (FIG. 4). The bulb electrical power supply line 94 has a series of electrical bulbs 96 connected in parallel thereto, the bulbs being spaced apart around the periphery of the message plate 32 received recessed therein as best seen in FIG. 4 so as to illuminate any message unit formed on the message plate, in this case, the main message unit 36 and any exposed of the right and left signal indicators 38 and 40.

The automatic switchover device 92 is constructed and arranged such that, as stated, it will normally transmit directly therethrough the 12 volt alternating current electrical power received from the sign electrical power supply line 90 and directed into the bulb electrical power supply line 94, but if a power failure should occur in the building electrical power supply, thereby cutting off the normal 12 volt alternating current into the automatic switchover device, this device will automatically convert to supplementary 12 volt direct current battery power. This battery power is supplied from battery 98 which is appropriately connected through battery electrical power supply lines 100 to the automatic switchover device 92. In this manner, the sign bulbs 96 will continue to be supplied electrical power for illuminating the sign unless the power outage remains for a long inordinate time. When the power outage is eliminated, the automatic switchover device 92 will automatically switch back to supplying the bulbs 96 with the normal alternating current power from the building supply as hereinbefore described.

In addition to the foregoing functioning of the automatic switchover device 92, this automatic switchover device may additionally be constructed and arranged to constantly provide a charge for the battery 98 when the sign is operating normally for illumination of the bulbs 96 by virtue of electrical power received from the building normal alternating current electrical power supply. In this manner, the battery 98 when it is, in effect, on "standby," it is always maintained at maximum charge so that if a building power outage does occur and the battery is required to illuminate the sign, it will always start at a full charge condition at the beginning of the power outage and will, therefore, be capable of providing direct current electrical power for a maximum period of time. This is particularly important where the sign construction is in the nature of an emergency sign such as will be the usual situation with exit signs of the preferred embodiment shown.

In use of the selectively displayable directional signal improvements of the present invention, as described in the preferred embodiment of sign construction, if the exit sign is to be mounted closely above or closely side adjacent an exit door or opening of the building, both of the right and left directional signal openings 46 and 48 will remain closed by the right and left cover strips 50 and 52 being positioned forwardly of the message plate 32 and rearwardly of the border strip 44 thereby covering the right and left signal indicators 38 and 40. The sign, therefore, will merely display the main message unit 36 or the word "exit" from the message plate 32. This will serve the proper function of indicating the closely adjacent exit door or opening.

If, however, the particular building exit sign must properly be mounted away from an exit door or opening and the sign is to function as not only the exit indicating sign, but also the directional sign for indicating the direction of that exit, one or the other or both of the right and left signal indicators 38 and 40 must be exposed and come into play. Assume that the exit sign is to additionally display the right signal indicator 38 and the left signal indicator 40 is to remain covered and not displaying as shown in FIGS. 1 and 6, the workmen installing the sign will merely urge the right side of the message plate 32 rearwardly within the frame 10 against the resilient retention of the springs 56 and will slideably remove the right cover strip 50, FIGS. 1 and 6 showing this right cover strip having been removed. This uncovers the right directional signal opening 46 and exposes the right signal indicator 38 as shown, so that the sign will then not only display the "exit" main message unit 36, but will also display the right signal indicator 38 which is the right directional signal indicating that the "exit" is to the right.

Obviously, this same convenient procedure can be quickly and easily followed for preparing the sign construction to directionally indicate in both right and left directions, or solely in the left direction.

Furthermore, if additional or different directional signals were required in the sign construction, for instance, indicating vertically up or vertically down, this same convenient form of construction and selective functional use could be followed, all within the principles of the present invention. Thus, with the selectively displayable directional signal principles of the present invention, a single model of sign can serve where multiple models were required with the prior sign constructions so as to minimize both the expense of providing the signs and the installation and maintenance of the same.

In use of the sign mounting bracket improvements of the present invention as illustrated in the preferred embodiment of sign construction hereinbefore described, the mounting bracket 58 in this preferred embodiment is positioned secured on the sign frame back panel 20 adapting the sign for mounting on or against a vertical wall mounting surface 64. Once the bracket sign part 60 is secured to the sign frame back panel 20 and the bracket mounting surface part 62 is secured to the vertical wall mounting surface 64, the sign is quickly and simply secured in mounted position for use without alteration over a great number of years merely by slideably vertically downwardly engaging the bracket sign part 60 with the bracket mounting surface part 62 to securely interengage or interfit the dove-tail projection 76 within the dove-tail recess 72 with the set screw 78 then being secured in usual manner for additionally insuring retention of that assembly. Furthermore, with the simple, but necessary, electrical connection of the bracket mounting surface part 62 to the building main electrical power supply having been made at the time of securing this bracket mounting surface part on the vertical wall mounting surface 64, when the bracket sign and mounting surface parts 60 and 62 are brought into this assembled securement, the male and female electrical connectors 80 and 84 are also automatically slideably brought into electrical connection completing the electrical circuit so that the installation of the sign on this vertical wall mounting surface is complete.

If the sign construction is to be mounted on other building wall or ceiling surfaces, as hereinbefore pointed out, this same improved mounting bracket 58 can be adapted for securement to any other of the panel surfaces of the sign frame 10, that is, the right side panel 12, the left side panel 14, the top panel 16 and the bottom panel 18. The exact same procedure is followed which will be obvious to those skilled in the art. Thus, an improved sign mounting bracket construction is provided adaptable for any type of sign mounting use and which not only securely mounts the sign usable over a long period of years by the unique dove-tail interconnection thereof, but also at the same time conveniently provides the necessary alternating current electrical connection for electrically illuminating the sign, this unique sign mounting and electrical connection procedure providing maximum convenience and a reduction of cost both in original installation and at the time of necessary maintenance operations.

I claim:

1. In a sign construction of the type having a box-like frame with a bordering flange defining a front face opening and a message plate enclosed by said frame displaying a message unit discernible forwardly through said frame front face opening; the improvements comprising: opaque opposite side border strips between said message plate and said frame bordering flange, said border strips extending oppositely inwardly along and forwardly of said message unit positioned therebetween, a directional signal opening formed through each of said border strips inwardly of said frame bordering flange; said message plate displaying contrasting coloration relative to said border strips through said directional signal openings of said border strips so as to be normally discernible forwardly through said directional signal openings; each of said directional signal openings of said border strips being formed in the pattern of a directional signal; selectively slideably removable cover strips overlying said message plate and underlying said border strips covering said directional signal openings of said border strips and of the same coloration as said border strips, said cover strips being selectively removable by sliding along said message plate from beneath said border strips without appreciably disturbing assembly of said message plate and border strips; whereby, when said cover strips are in assembly covering said border strips directional signal openings, said same coloration as said border strips prevents discernment of said directional signal openings, and when said cover strips are slideably removed, said message plate contrasting coloration display permits ready discernment of said directional signal openings.

2. In a sign construction as defined in claim 1 in which said directional signal openings of said border strips and said contrasting coloration of said message plate at said directional signal openings are formed in patterns of directional signals and register one with the other.

3. In a sign construction a defined in claim 1 in which resilient means is positioned in said frame resiliently urging said message plate forwardly toward said frame bordering flange and forwardly resiliently retaining assembly of said message plate, border strips and removable cover strips, said resilient means permitting said cover strip selective slideable removal without appreciably disturbing assembly of said message plate and border strips.

4. In a sign construction as defined in claim 1 in which said directional signal openings of said border strips and said contrasting coloration of said message plate at said directional signal openings are formed in patterns of directional signals and register one with the other; and in which resilient means is positioned in said frame resiliently urging said message plate forwardly toward said frame bordering flange and forwardly resiliently retaining assembly of said message plate, border strips and removable cover strips, said resilient means permitting said cover strip selective slidable removal without appreciably disturbing assembly of said message plate and border strips.

* * * * *